US006523310B1

(12) United States Patent
Tseng

(10) Patent No.: US 6,523,310 B1
(45) Date of Patent: Feb. 25, 2003

(54) TREAD AND HANDRAIL COMBINATION STRUCTURE OF A STAIRCASE

(75) Inventor: Chen-Nung Tseng, Chia Yi Hsien (TW)

(73) Assignee: Taiwan Lounge Chair Industry Co., Ltd., Chia Yi Hsien (TW)

( * ) Notice: Subject to any disclaimer, the term of this patent is extended or adjusted under 35 U.S.C. 154(b) by 0 days.

(21) Appl. No.: 09/994,044

(22) Filed: Nov. 23, 2001

(51) Int. Cl.[7] ..... E04F 11/00
(52) U.S. Cl. ..... 52/187; 52/188; 52/182
(58) Field of Search ..... 52/187, 188, 189, 52/190, 191

(56) References Cited

U.S. PATENT DOCUMENTS 1,215,352 A * 2/1917 Divinage ..... 52/187
4,041,662 A * 8/1977 Ward ..... 52/187
4,438,608 A * 3/1984 Hamm ..... 52/187
4,881,351 A * 11/1989 Hamm ..... 52/182
5,163,491 A * 11/1992 Smith ..... 144/353
5,347,774 A * 9/1994 Smith ..... 52/182
6,155,007 A * 12/2000 Murase ..... 52/187

* cited by examiner

*Primary Examiner*—Jeanette Chapman
(74) *Attorney, Agent, or Firm*—Alan Kamrath; Rider Bennett Egan & Arundel, LLP

(57) ABSTRACT

The present invention relates to a tread and handrail combination structure of a staircase, including a support post, multiple helically laminated treads mounted on the support post, and multiple juxtaposed handrails. Each tread has an outer side provided with multiple combination holes, so that two ends of each handrail may pass through the combination holes to be fixed on the tread. Each tread has a bottom face provided with a support tube aligned with one combination hole. One end of each handrail is screwed on the tread, and the other end of each handrail is extended through the combination hole and the support tube of the mating tread, and through the combination hole of a next tread, so that any two adjacent treads may be combined rigidly and stably, without deformation.

3 Claims, 2 Drawing Sheets

TREAD AND HANDRAIL COMBINATION STRUCTURE OF A STAIRCASE

BACKGROUND OF THE INVENTION

1. Field of the Invention

The present invention relates to a tread and handrail combination structure of a staircase, and more particularly to a tread and handrail combination structure of a staircase, wherein the combination end of each handrail may simultaneously pass through any two adjacent treads so as to lock and secure the two adjacent treads, and the two adjacent treads may be supported by the support tube. Thus, the treads may be combined rigidly and stably, thereby increasing the structural strength of the combined treads, and thereby preventing the combined treads from being deformed and vibrated.

2. Description of the Related Art

A conventional helical arranged staircase in accordance with the prior art as disclosed in Taiwanese Patent Publication No. 139721, comprises handrail bodies having a bottom provided with a bottom connection portion mounted on boards and having two sides provided with a first connection portion and a second connection portion.

However, the conventional helical arranged staircase in accordance with the prior art has the following disadvantages.

Any two adjacent boards are connected by each handrail body. Each board has an inner side supported by a support post, and the outer sides of the boards are connected by the handrails. But, the outer side of each board is disposed at a suspension state, so that when the boards are pressed by weight, they are easily bent or deformed downward, thereby easily causing vibration or deformation.

In addition, a greater distance is defined between the outer side of the board and the upper end of the handrail body, so that the included angle between any two adjacent boards will easily deviate, and so that the included angle between any two adjacent boards is unstable.

SUMMARY OF THE INVENTION

The present invention has arisen to mitigate and/or obviate the disadvantage of the conventional helical arranged staircase.

The primary objective of the present invention is to provide a tread and handrail combination structure of a staircase, wherein the combination end of each handrail may simultaneously pass through any two adjacent treads so as to lock and secure the two adjacent treads, and the two adjacent treads may be supported by the support tube. Thus, the treads may be combined rigidly and stably, thereby increasing the structural strength of the combined treads, and thereby preventing the combined treads from being deformed and vibrated.

Another objective of the present invention is to provide a tread and handrail combination structure of a staircase, wherein the distance between the upper combination points and the lower combination points of the handrail is not too long, so that the included angle between any two adjacent treads will not deviate, and so that the helical arrangement of the treads is more exact without displacement due to pressure of weight.

In accordance with the present invention, there is provided a tread and handrail combination structure of a staircase, comprising: a support post, multiple helically laminated treads mounted on the support post, and multiple juxtaposed handrails, each tread having an outer side end provided with multiple combination holes, so that two ends of each handrail may pass through the combination holes to be fixed on the tread, wherein:

each tread has a bottom face provided with a support tube aligned and communicated with one of the combination holes, one end of each handrail is directly screwed on the tread, the other end of each handrail is extended through the combination hole and the support tube of the mating tread, and is extended through the combination hole of a next tread, so that any two adjacent treads may be combined rigidly and stably, without deformation.

Further benefits and advantages of the present invention will become apparent after a careful reading of the detailed description with appropriate reference to the accompanying drawings.

DETAILED DESCRIPTION OF THE INVENTION

Figure 1:
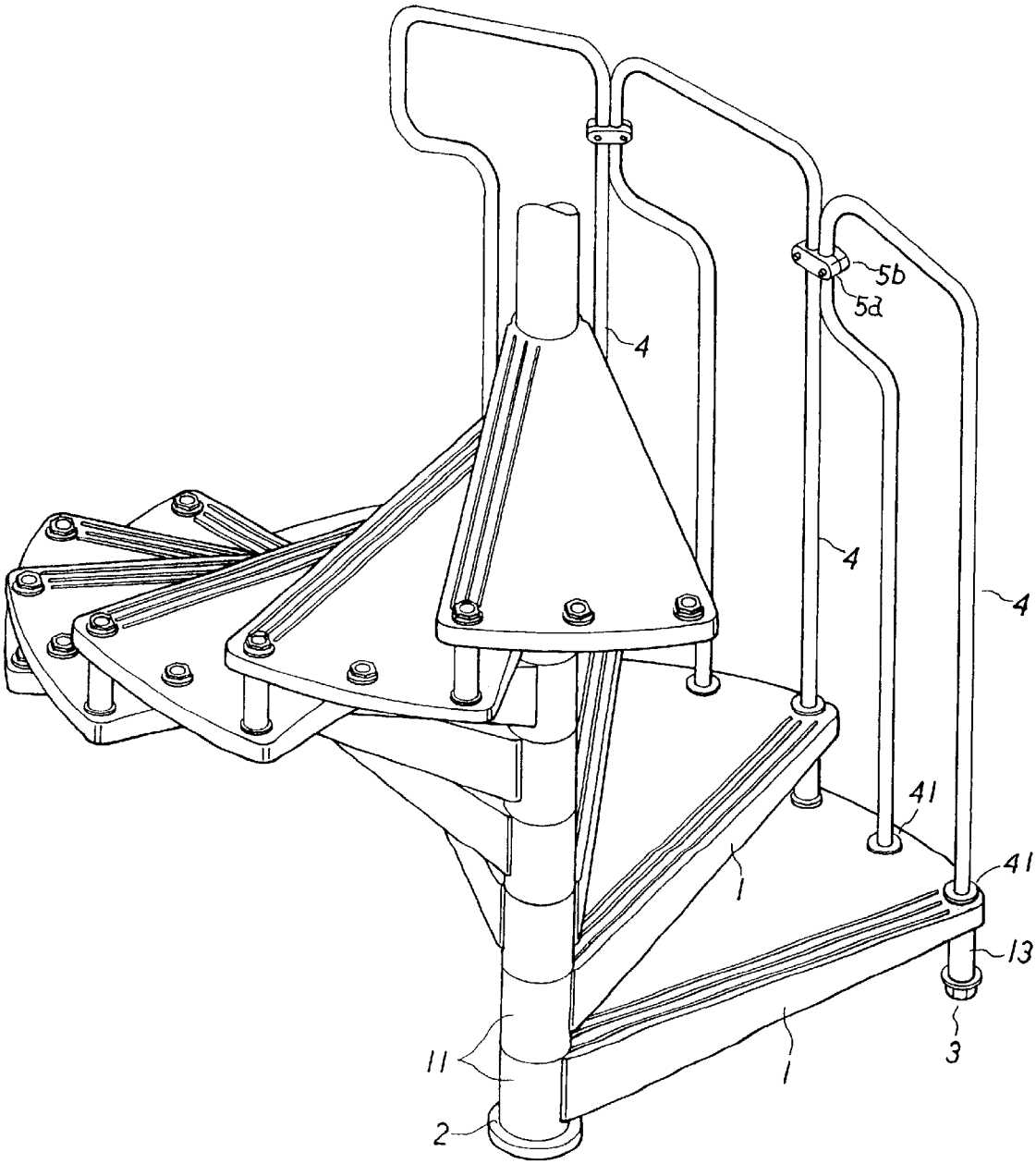
FIG. 1 is a perspective view of a tread and handrail combination structure of a staircase in accordance with a preferred embodiment of the present invention.
Figure 2:
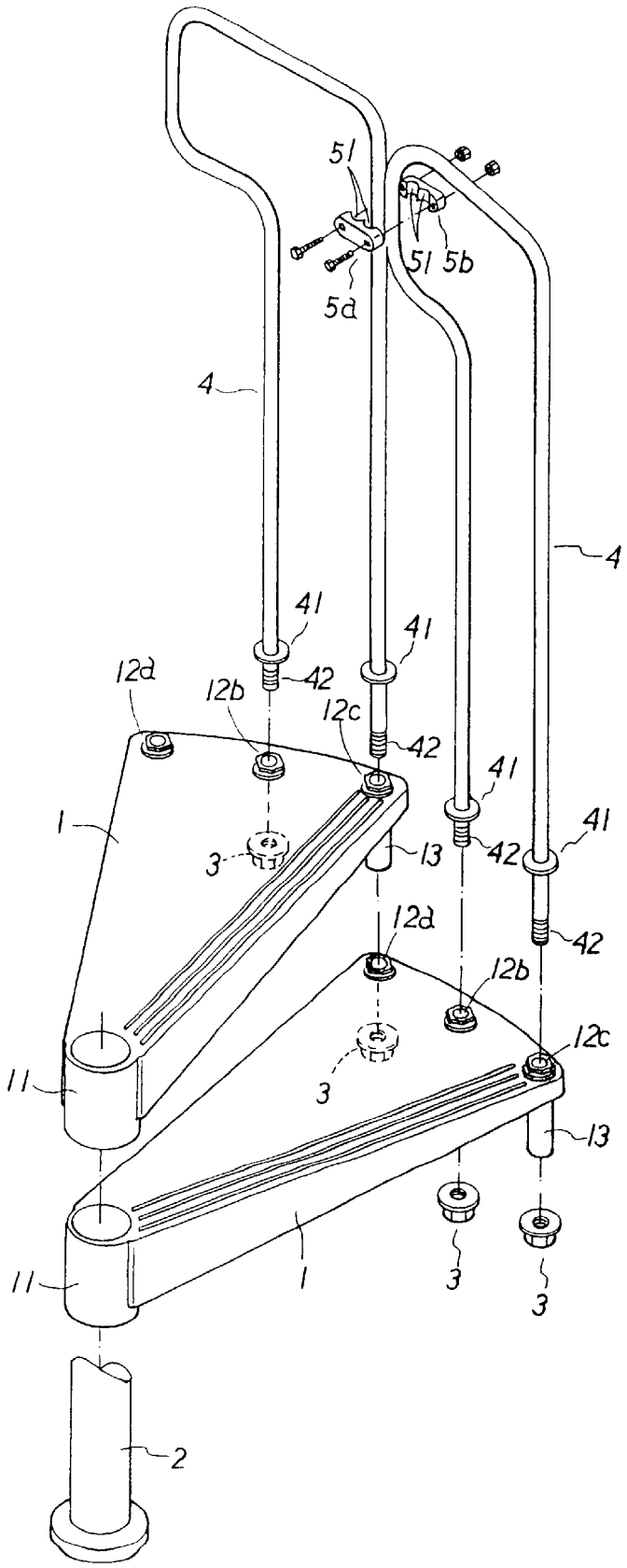
FIG. 2 is a partially exploded perspective view of the tread and handrail combination structure of a staircase as shown in FIG. 1.

Referring now to FIGS. 1 and 2, a tread and handrail combination structure of a helical staircase in accordance with a preferred embodiment of the present invention comprises a support post 2, multiple laminated treads 1, and multiple juxtaposed handrails 4.

Each of the treads 1 is a substantially sector-shaped board, and has a first end formed with a sleeve 11 mounted on the support post 1, and a second end formed with multiple combination holes 12*a*, 12*b* and 12*c*. The second end of each of the treads 1 has a bottom face provided with a support tube 13 aligned and communicated with the combination hole 12*c*.

Each of the handrails 4 is formed by bending an L-shaped rod, and has two distal ends each formed with a threaded combination end 42 and a flange portion 41 located above the combination end 42. The combination end 42 of a first distal end of the handrail 4 is located at a position greater than that of the combination end 42 of a second distal end of the handrail 4.

In assembly, the sleeve 11 of each of the treads 1 is mounted on the support post 1, so that the treads 1 may be laminated with each other, and may be arranged in a helical manner. The two combination ends 42 of each of the handrails 4 are extended through the combination holes 12*b* and 12*c* of the mating tread 1, and the two flange portions 41 of each of the handrails 4 are rested on the top end of the combination holes 12*b* and 12*c* of the mating tread 1. One of the two combination ends 42 of each of the handrails 4 is in turn extended through the combination hole 12*b* of the mating tread 1, and screwed into a nut 3. The other one of the two combination ends 42 of each of the handrails 4 is in turn extended through the combination hole 12*c* of the mating tread 1, through the support tube 13 of the mating tread 1, and through the combination hole 12*a* of a lower tread 1, and is screwed into a nut 3.

Between the two upper ends of any two adjacent handrails 4 are provided with two opposite clamp blocks 5*a* and 5*b*.

The opposite inner side faces of the two opposite clamp blocks 5*a* and 5*b* are formed with recesses 51 for receiving the two upper ends of the two adjacent handrails 4, so that the two upper ends of the two adjacent handrails 4 may be clamped and secured between the two opposite clamp blocks 5*a* and 5*b* by screws.

Accordingly, one of the two combination ends 42 of each of the handrails 4 is in turn extended through the combination hole 12*c* of the mating tread 1, through the support tube 13 of the mating tread 1, and through the combination hole 12*a* of a next tread 1, and is screwed into a nut 3, and the lower end of the support tube 13 is rested on the top face of the next tread 1, so that one of the two combination ends 42 of each of the handrails 4 may lock and secure any two adjacent treads 1, and the two adjacent treads 1 may be supported by the support tube 13. Thus, the treads 1 may be combined rigidly and stably, thereby increasing the structural strength of the combined treads 1, and thereby preventing the combined treads 1 from being deformed and vibrated. In addition, the distance between the upper combination points and the lower combination points of the handrail 4 is not too long, so that the included angle between any two adjacent treads 1 will not deviate, and so that the helical arrangement of the treads 1 is more exact without displacement due to pressure of weight.

In conclusion, in accordance with a tread and handrail combination structure of a helical staircase of the present invention, the combination end of each of the handrails may simultaneously pass through any two adjacent treads so as to lock and secure the two adjacent treads, and the two adjacent treads may be supported by the support tube. Thus, the treads may be combined rigidly and stably, thereby increasing the structural strength of the combined treads, and thereby preventing the combined treads from being deformed and vibrated.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A tread and handrail combination structure of a staircase, comprising: a support post, multiple helically laminated treads mounted on the support post, and multiple juxtaposed handrails, each tread having an outer side end provided with multiple combination holes, so that two ends of each handrail may pass through the combination holes to be fixed on the tread, wherein:

each tread has a bottom face provided with a support tube aligned and communicated with one of the combination holes, one end of each handrail is directly screwed on the tread, the other end of each handrail is extended through the combination hole and the support tube of the mating tread, and is extended through the combination hole of a next tread, so that any two adjacent treads may be combined rigidly and stably, without deformation.

2. The tread and handrail combination structure of a staircase in accordance with claim 1, wherein each of the handrails is formed by bending an L-shaped rod, and has two distal ends each formed with a threaded combination end and a flange portion located above the combination end, and the combination end of a first distal end of the handrail is located at a position greater than that of the combination end of a second distal end of the handrail.

3. The tread and handrail combination structure of a staircase in accordance with claim 1, wherein between the two upper ends of any two adjacent handrails are provided with two opposite clamp blocks, and the opposite inner side faces of the two opposite clamp blocks are formed with recesses for receiving the two upper ends of the two adjacent handrails, so that the two upper ends of the two adjacent handrails may be clamped and secured between the two opposite clamp blocks by screws.

* * * * *